United States Patent [19]

Adachi et al.

[11] 4,435,072

[45] Mar. 6, 1984

[54] IMAGE RECORDING APPARATUS WITH LEAKAGE PREVENTING MICROWAVE FIXING DEVICE

[75] Inventors: Hiroyuki Adachi, Tokyo; Nagao Hosono, Chofu, both of Tokyo, Japan

[73] Assignee: Canon Kabushiki Kaisha, Tokyo, Japan

[21] Appl. No.: 327,686

[22] Filed: Dec. 4, 1981

[30] Foreign Application Priority Data

Dec. 11, 1980 [JP] Japan ..... 55-174898
Dec. 11, 1980 [JP] Japan ..... 55-174899
Dec. 11, 1980 [JP] Japan ..... 55-174902

[51] Int. Cl.[3] ..... G03G 15/20

[52] U.S. Cl. ..... 355/3 FU; 219/216; 219/10.55 A

[58] Field of Search ..... 355/3 FU, 14 FU; 219/216, 388, 10.55 A, 10.55 F; 34/1

[56] References Cited

U.S. PATENT DOCUMENTS 3,050,606 8/1962 Tibbs ..... 219/10.55
3,705,819 12/1972 Heller et al. ..... 219/10.61
4,081,213 3/1978 Bar-On et al. ..... 355/3 FU
4,112,285 9/1978 Pan et al. ..... 219/10.41

FOREIGN PATENT DOCUMENTS 285100 9/1965 Australia ..... 219/10.55 A
1173816 12/1969 United Kingdom ..... 219/10.55 A

OTHER PUBLICATIONS

*Xerox Disclosure Journal*, "Toner Fusion Using R. F. Fields and Utilizing Curie Temperature of Toner Additive," p. 49, vol. 2, No. 2, Mar./Apr. 1977.

*Primary Examiner*—Richard L. Moses
*Attorney, Agent, or Firm*—Fitzpatrick, Cella, Harper & Scinto

[57] ABSTRACT

An image formation apparatus having an image formation station for causing a recording medium to bear a visualized image, a fixing station for applying high-frequency waves to thereby fix the visualized image on the recording medium and record the image, a conveyor for conveying the recording medium along a conveyance path from the image formation station until the recording medium passage through the fixing station, and a device for preventing leakage of the high-frequency waves for fixing the visualized image on the recording medium. The fixing station has a high-frequency wave applying process for fixing the visualized image on the moving recording medium. The image formation apparatus effectively utilizes the high-frequency waves for the image formation while, on the other hand, it prevents wasteful leakage of the high-freqency waves or leakage of the high-frequency waves which interferes with humans or image formation and ensures safety.

48 Claims, 16 Drawing Figures

IMAGE RECORDING APPARATUS WITH LEAKAGE PREVENTING MICROWAVE FIXING DEVICE

BACKGROUND OF THE INVENTION

1. Field of the Invention

This invention relates to an image recording apparatus in which high-frequency waves are applied at a fixing station in the image formation process of a copying apparatus or an information recording apparatus to thereby fix a visualized image on a recording medium and record the image.

2. Description of the Prior Art

A heating-fixing method using high-frequency waves such as microwaves and a device therefor have already been disclosed in Japanese Patent Publication No. 38171/1974, Japanese Laid-open Patent Application No. 20039/1977 and Japanese Patent Publication No. 10865/1979. This high-frequency wave heating-fixing device is an excellent one which has eliminated the following disadvantages in the so-called extraneous heating and fixation. That is, it is a compact a device which reduces the wait time until a temperature necessary for fixation is reached, which eliminates the danger of fire or the like occuring when a recording medium such as paper stays within the fixing area by some cause or other, and which prevents creation of wrinkles and disturbance of image which would otherwise result from the contact of the recording medium with a heating roller or the like.

However, the use of a high-frequency waves makes it necessary to take sufficient care of leakage of the high-frequency waves, whereas means for solving such a problem has not been provided in any image formation apparatus.

When such a high-frequency wave heating-fixing device is employed as the fixing device in an image formation apparatus such as an electrophotographic copying apparatus or other information recording apparatus, there occurs a disadvantage or inconvenience that high-frequency waves may leak to the outside of the fixing device and further to the outside of the copying apparatus or the recording apparatus. Typical of such inconvenience are the creation of noise in an IC mechanism provided in a multistage tray or other instrument disposed outside the image formation apparatus and the influence imparted to humans. Also, in the image formation apparatus, there may be conceived a case where the high-frequency waves imparted from an inadvertent portion to an optical system member designed to impart a predetermined exposure amount to thereby disturb the distribution of light or a case where an unnecessary magnetic field or the like is created due to leakage of high-frequency waves to thereby adversely affect the image formation process.

In any case, preventing unnecessary leakage of high-frequency waves is necessary for maintaining the stability of the predetermined image formation.

SUMMARY OF THE INVENTION

It is an object of the present invention to provide a novel image recording apparatus capable of preventing leakage of high-frequency waves in the image recording apparatus which uses high-frequency waves for fixation.

It is another object of the present invention to provide an image recording apparatus capable of effecting safe and good fixation while making the best use of the advantages of a fixing device using high-frequency waves.

It is still another object of the present invention to eliminate the above-noted inconveniences.

It is yet still another object of the present invention to provide an image formation apparatus having a fixing device which prevents leakage of high-frequency waves while making the best use of the advantages of the fixing device using high-frequency waves and which utilizes the prevented high-frequency waves as an auxiliary heat source for image fixation to effect safe and good fixation.

Other objects and features of the present invention will become apparent from the following detailed description taken in conjuction with the accompanying drawings.

DESCRIPTION OF THE PREFERRED EMBODIMENTS

Figure 1:
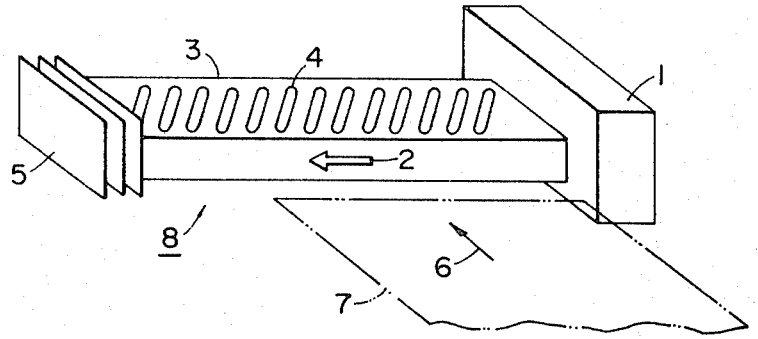
FIG. 1 is a schematic view illustrating the microwave heating-fixing device according to the present invention.
Figure 2:
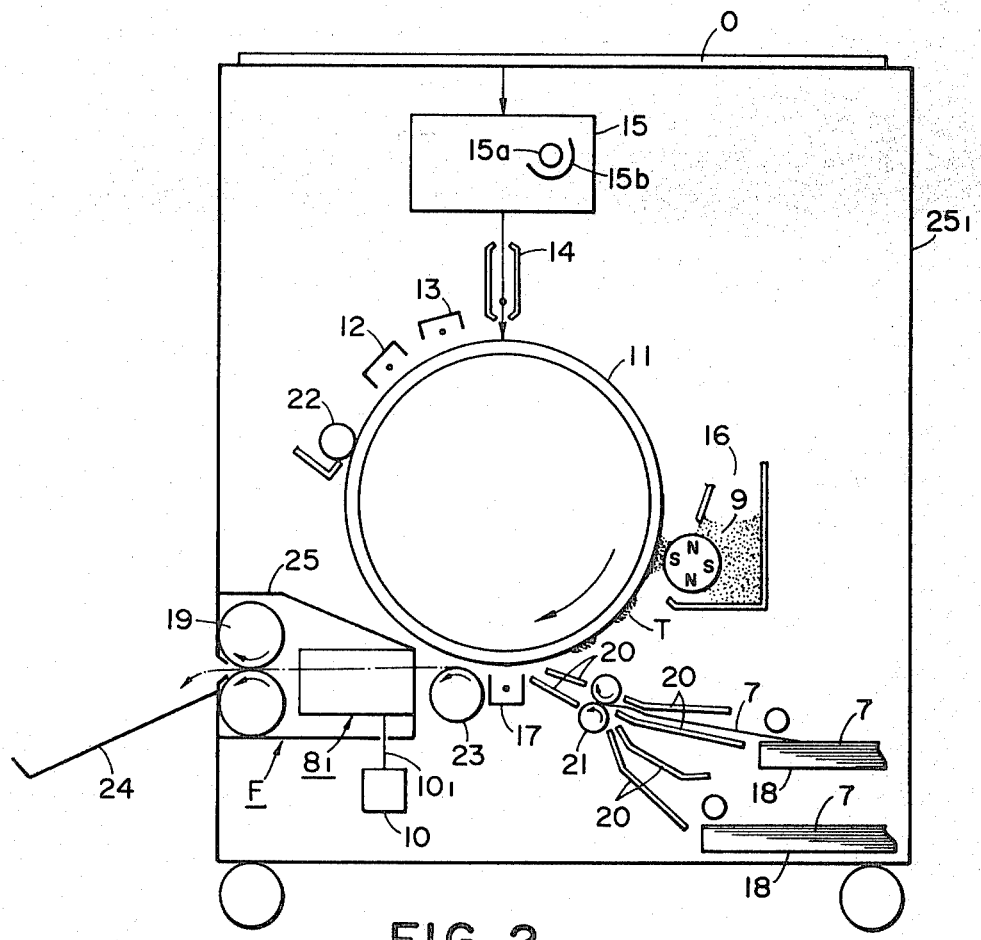
FIG. 2 illustrates an embodiment in which the present invention is applied to an electrophotographic copying apparatus.

Referring to FIG. 1, reference numeral 1 designates a microwave oscillator which generates microwaves having a component of an electric field in a transmission direction 2. A magnetron stronger than a magnetron used in an electronic range for domestic use is used in this microwave oscillator 1. Designated by 3 is a wave guide tube having a rectangular configuration in which microwaves are transmitted through the tube in the direction of arrow 2. The wave guide tube 3 is provided in parallel to a recording medium 7. On a surface relative to which the reverse surface of the side of the recording medium which bears an image, a number of slits 4 are parallel-disposed, for example, at an angle of 45° with respect to the conveyance direction 6 of the recording medium 7. By the slits 4 being so angled with respect to the conveyance direction 6 of the recording medium, any portion of the recording medium passes any portion of any slit and therefore, microwave energy is uniformly applied through the slits 4 to the perpendicular surface of the recording medium in the conveyance direction 6. Also, if the slits are obliquely provided at an angle with respect to the conveyance direction as described above, wasteful leakage of microwaves can be suppressed. Denoted by 5 is a cooling device provided perpendicularly to the wave guide tube 3. The cooling device 5 has the wave guide tube interposed between it and the microwave generator 1 and prevents generation of the standing wave of the generated microwaves and extinguishes any high-frequency wave energy which returns to the generator. Reference is now had to FIG. 2 to describe an embodiment in which this dielectric heating device 8 is applied to an electrophotographic copying apparatus.

As is well known, a photosensitive drum 11 having a photosensitive layer on the surface thereof is rotated at a velocity v in the direction of arrow by the drive force of a drive source (not shown) in response to a copy signal and is pre-discharged by a pre-discharging charger 12. Subsequently, the photosensitive drum 11 is charged by a primary charger 13, and then is subjected to secondary discharging by a secondary charger 14. On the other hand, simultaneously therewith, the image of an original O is scanned by an optical device 15 including an optical member and optical member moving means (or alternatively, the optical device 15 is fixed and the original O or an original carriage (not shown) is moved), whereby image exposure is effected on the photosensitive drum 11 at a desired magnification (one-to-one magnification, reduction or enlargement) of the original. The photosensitive drum is then subjected to whole surface exposure, whereby an electrostatic latent image is formed on the drum 11. This latent image is developed into a visible image T by developer 9 in a developing device and is rotated with the drum 11 to arrive at an image transfer charger 17.

On the other hand, the recording medium 7 is fed from a cassette 18 and along a guide member 20 and is conveyed toward the drum 11 with a timing taken by register rollers 21 to receive the visualized image T. Subsequently, the recording medium 7 is charged to a polarity opposite to the visualized image T from the back side thereof by the image transfer charger 17, whereby the visualized image T is transferred onto the recording medium 7. Thereafter, the photosensitive drum 11 has its surface cleaned by a cleaning roller 22, thus becoming ready for another cycle of copying.

On the other hand, the recording medium 7 now positively bearing the visualized image T thereon is separated from the photosensitive drum 11 by a separating roller 23 for separating one side of the recording medium and is conveyed to a fixing station F adjacent to the photosensitive drum 11. Such conveyance of the recording medium may be accomplished by the use of well-known conveyor means.

The construction of the fixing station Fis similar to that described in connection with FIG. 1 and, on the recording medium 7, the visualized image T is dielectrically heated by the microwave and is fixed as an image.

The visualizer (or toner) 9 forming the visualized image T uses a dielectric substance, an electrically conductive substance or a magnetic substance as the chief component thereof, and these substances generate heat by eddy current loss, dielectric loss, hysteresis loss, residual magnetism loss or the like depending on a certain frequency area.

The recording medium 7 having the image so fixed thereon is discharged by a discharge station having a pair of discharge rollers 19 onto a tray 24 provided outwardly of the fixing station F and the entire image formation apparatus.

In FIG. 2, reference numeral 10 designates high-frequency wave generator means and reference numeral $10_1$ denotes a coaxial cable for transmitting high-frequency waves from the generator means 10 to high-frequency waves applying means $8_1$. This high-frequency wave applying means $8_1$ and the pair of discharge rollers 19 are surrounded by surrounding means having a casing 25, whereby leakage of high-frequency waves from the fixing station F is prevented. The entire image formation apparatus is usually prevented from leakage of high-frequency waves by a casing $25_1$.

Some embodiments of the present invention in the fixing station F will now be described with reference to FIGS. 3 to 10.

Figure 3:
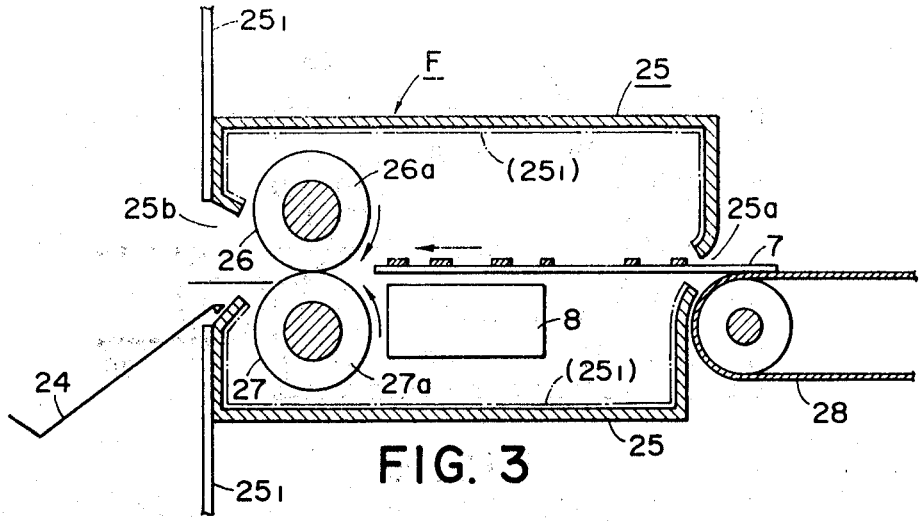
FIG. 3 illustrates the portions around the fixing station in an embodiment of the present invention.

In FIG. 3, reference numerals 26 and 27 designate a pair of rollers formed of high-frequency wave absorbing materials **26*a* and 27*a* (for example, melamine resin or rubber) and provided in the conveyance path of the recording medium 7 within the casing 25 provided in the fixing station F. The recording medium 7, after the image thereon has been developed, enters into the casing 25 through an inlet 25*a* by means of a conveyor belt 28 and passes through the dielectric heating device 8 (only one such device is shown in FIG. 3, but a number of such devices may be disposed) and between the rollers 26 and 27, and then is discharged out of a casing 14 through an outlet 14*b***.

The high-frequency waves emitted from the dielectric heating device 8 effectively contributes to fixation, but part of it is applied to the other portion than the recording medium 7. This excess of high-frequency waves is reflected and scattered in the fixing station F and yet is absorbed by the high-frequency wave absorbing materials **26*a* and 27*a* to prevent high-frequency waves from leaking toward the recording medium 7 discharging portion. In this case, the rollers 26 and 27 formed of the high-frequency wave absorbing materials 26*a* and 27*a* absorb the high-frequency waves and generate heat and function as heating-fixing rollers discrete from the dielectric heating device 8. That is, the rollers 26 and 27 formed of the high-frequency wave absorbing materials 26*a* and 27*a*** absorb any excess high-frequency waves to prevent the excess high-frequency waves from leaking to the outside and also function as heating-fixing rollers.

Figure 4:
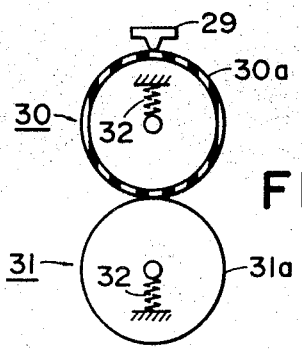
FIG. 4 illustrates a pair of rollers applicable to each of the arrangements of FIGS. 3, 5 and 6.
Figure 5:
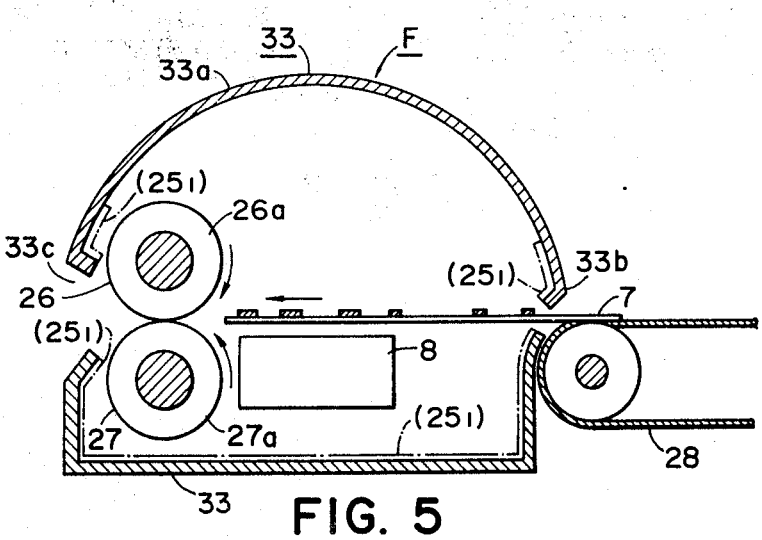
FIGS. 5, 6 and 7 illustrate the portions around the fixing station in further embodiments of the present invention.

The pair of rollers 26 and 27 may result in a similar effect even if one of them is comprised of a metal roller 31 and the other is comprised of a high-frequency wave absorbing roller 30, as shown in FIG. 4. In FIG. 4, reference numeral **31*a* designates a metal roller formed of aluminum, stainless steel or the like, and reference numeral 30*a* denotes silicon rubber. Further, a pressure is applied between the two rollers 30 and 31 by a conventional pressing mechanism such as a spring 32, whereby the visualizer is embedded into the recording medium 7, thus providing a better fixed image. Reference numeral 29 designates a parting agent applying device which imparts a parting property to the roller 30, but this will be unnecessary depending on the quality of the silicon rubber 30*a*. Further, if ferrite is dispersed in the silicon rubber 30*a***, there will be obtained a greater high-frequency wave absorbing effect.

In FIG. 3, reference numeral 25 designates the casing which covers the dielectric heating device 8 and which, in the present embodiment, is formed of melamine resin. However, a plate-like high-frequency wave absorbing member $25_1$ having a rubber layer may preferably be attached to a part or the whole of the inner surface of the casing 25. Further, a metal plate formed of iron, aluminum or the like may be used as the casing to reflect high-frequency waves and provide a greater fixing effect. The shape of such metal plate need not be planar as shown in FIG. 3, but if the metal plate is made into a casing 33 of a shape having a curved surface portion having such a curvature 33*a* that the high-frequency waves concentrate in the fixing portion, as shown, in FIG. 5, the fixing effect will further be improved. Reference character 33*b* designates an inlet for the recording medium 7, and reference numeral 33*c* denotes an outlet for the recording medium 7, and an absorbing menber $25_1$ may be provided adjacent to the outlet in the lower or upper inner surface of the casing 33.

Figure 6:
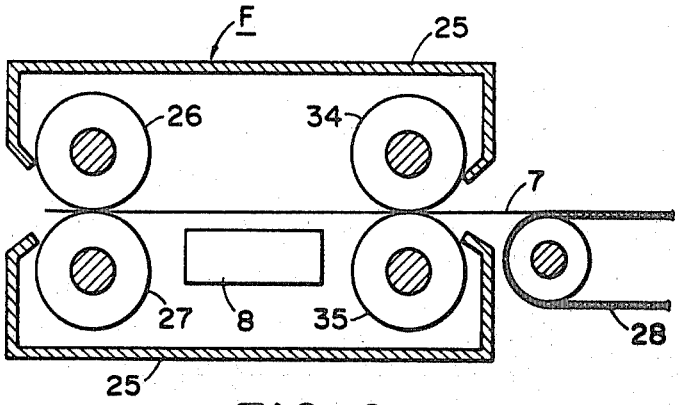

FIG. 6 shows another embodiment. In this embodiment in addition to the embodiment shown in FIG. 3, high-frequency wave absorbing rollers 34 and 35 are provided not only downstream of but also upstream of the dielectric having device 8 to further improve the auxiliary heating effect and the high-frequency wave leakage preventing effect. The interior of the rollers 24 and 35 may be formed into hollow metal rollers, and a high-frequency wave absorbing layer such as silicon rubber may be provided on the outer peripheral surface thereof, and a heat source may be provided in the hollow portions.

The above-described embodiment has been shown with respect only to an example in which the high-frequency wave absorbing rollers are provided downstream or both upstream and downstream of the dielectric heating device with respect to the conveyance direction of the recording medium, whereas, of course, such roller may be provided only upstream of the dielectric heating device. It is also possible that the upper or lower one of the pair of rollers is formed with a high-frequency wave absorbing material. The pair of rollers need not always be provided at one or two locations, but may of course be provided at several locations.

As described above, in each of the foregoing embodiments, leakage of the high-frequency wave is prevented by housing the dielectric heating device in a casing and using the high-frequency wave absorbing rollers within the casing, and also the heating of the high-frequency wave absorbing rollers by the high-frequency wave is used as auxiliary heating means for fixation to improve the efficiency of fixation.

Besides the above-described effects, leakage of the high-frequency waves from the fixing station F to the outside of the apparatus and/or to the other portions of the apparatus than the fixing device can be prevented. Accordingly, where the optical device 15 of FIG. 2 has members such as a fluorescent tube 15*a* and a reflector 15*b* and whole surface exposure or original scanning is effected by the use of such optical device, the problem that the fluorescent substance is caused to emit light by the high-frequency wave to disturb a predetermined exposure distribution can be prevented.

Reference is now had to FIGS. 7 to 10 to describe further embodiments.

Figure 7:
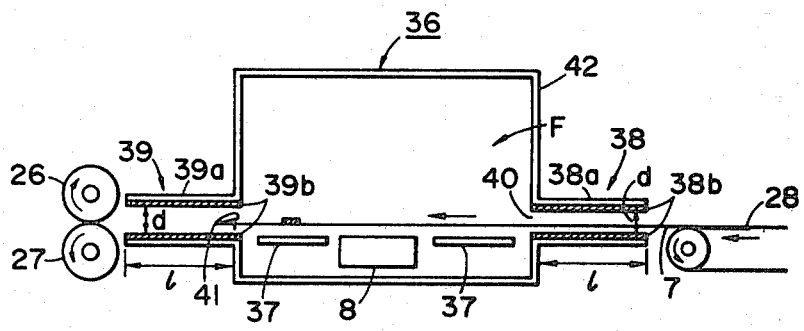
Figure 8A:
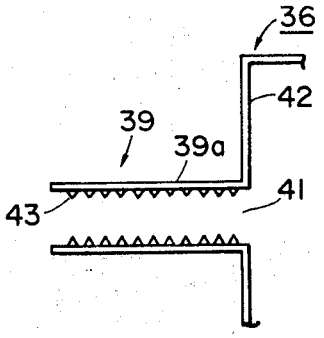
FIGS. 8A and 8B illustrate the essential protions of embodiments which are improvements over the embodiment of FIG. 7.
Figure 8B:
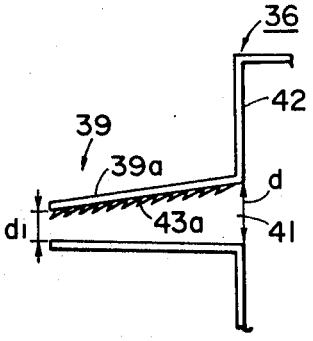

In FIG. 7, the recording medium 7 conveyed by a conveyor belt 28 passes to the upper portion of the dielectric heating device 8 surrounded by a casing 36 formed by a shield plate 42, whereupon the visualized image is melted and fixed on the recording medium 7, which is then discharged outwardly of the apparatus by paper discharge rollers 26, 27. The shield plate 42 is formed of a metal such as iron, aluminum or the like and, as previously mentioned, it forms a casing 22 and prevents leakage of the high-frequency waves to the outside of the apparatus. The shield plate 42 usually has an inlet opening 38 and an outlet opening 39 through which the recording medium 7 can pass. There is the danger of the high-frequency waves leaking from an inlet opening 40 and an outlet opening 41 for the recording medium 7 with respect to the fixing station F, but these openings are so shaped to have a width greater than the maximum width of the recording medium 7 with respect to the conveyance direction of the recording medium. Further, in the present embodiment, as shown, guide portions 38 and 39 are provided in the openings 40 and 41 so as to match these openings. In these guide portions 38 and 39, the height d of the openings which is perpendicular to the conveyance direction of the recording medium is selected to a value equal to or less than the half-wavelength of the high-frequency waves. Further, the openings have guide members 38*a* and 39*a* on the entire surface of the side walls thereof, the guide members 38*a* and 39*a* being formed by metal plates, and members 38*b* and 39*b* having a high-frequency wave absorbing property are joined to the inner surface of the openings. Resin having ferrite dispersed therein, or rubber material or rubber plates are applied to these members 38*b* and 39*b*, and the metallic portions thereof are grounded. Further, the length l of the openings with respect to the conveyance direction of the recording medium is set to the half-wavelength, more preferably to one wavelength or greater. By this setting, the impedance A in the vicinity of the openings 40 and 41 and the impedance B in the fixing station F having high-frequency wave generator means become different from each other, so that the high-frequency waves are attenuated as they pass through these guide portions 38 and 39 and thus, it does not adversely affect the exterior of the apparatus. Further, as shown in FIGS. 8A and 8B, convex portions 43 may be provided on the inside of the guide portion 39*a* to thereby form the inner surface thereof into a concavo-convex configuration and increase the surface area thereof, thus forming the impedance C ($\neq$impedance B) of the guide portion 39*a*. Further, said concavo-convex inner surface may be formed of a metal having ferrite dispersed therein and the metallic portion may be grounded, thereby forming impedance D different from the impedance B of the high-frequency generator means. In FIG. 8B, no concavo-convexity is provided on the surface on which the recording medium slides, but concavo-covexity 43*a* is provided on the other surface. Further, in FIG. 8B, the height of the opening is gradually decreased from d to $d_1(<d)$. Even in one of these two configurations, the impedances can be made differ from each other, and a combination of these would result in a better embodiment. In any case, the high-frequency wave is attenuated as it passes through the openings 40 and 41, and thus, it does not adversely affect the outside of the apparatus. Of course, such concavo-convex inner surface may be provided only on the guide portion 38*a* or on both of the guide portions 38*a* and 39*a*.

Figure 9:
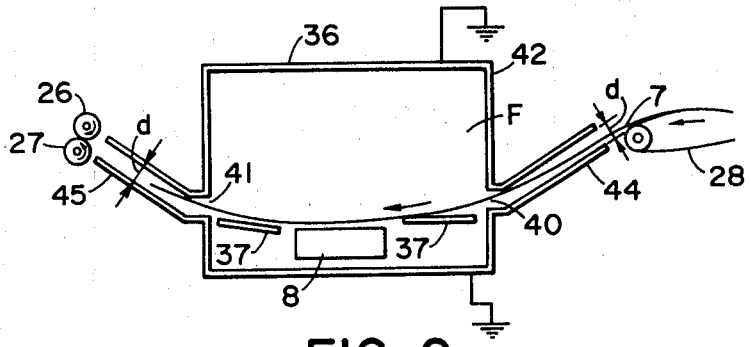
FIG. 9 illustrates the portions around the fixing station in still another embodiment of the present invention.

Still another embodiment will be decribed with reference to FIG. 9.

In this embodiment, inclined guide members 44 and 45 are provided in the openings 40 and 41 so as to vary the conveyance path of the recording medium. By this, high-freuency waves which try to leak from the openings 40 and 41 to the outside of the fixing station F impinge on these guide portions 44 and 45, whereby they are gradually attanuated and do not adversely affect the exterior of the apparatus. Particularly in the present embodiment, the guide members 44 and 45 are inclined with respect to the conveyance direction of the recording medium 7 by the conveyor belt 28 or to the fixing station F and therefore, the probability with which the high-frequency waves impinge on the guide members 44 and 45 becomes high and the impedances in the vicinity of the openings 40 and 41 differ from other and thus, the high-frequency waves are not capable of matching relative to the impedance variation. Accordingly, more reliable prevention of the leakage of the high-frequency waves can be provided. In the present embodiment, the guide members 44 and 45 are formed by metal plates, whereas the material thereof is not restricted thereto but various materials are usable. As regards the shape of the guide members 44 and 45, it is preferable that, as described in connection with FIG. 7, the height d be equal to or less than the half-wavelength of the main high-frequency wave wavelength and that the length l thereof be greater than the half-wavelength of that wavelength. Further, as in the previously described embodiment, resin or rubber plates which are high-frequency wave absorbing members may be attached to the inner surface of the guide members 44 and 45, or those inner surfaces may be made concavo-convex so as to make the impedances differ from each other so that impedance variation may occur in the conveyance path before and after the openings 40 and 41. Each of the previously described embodiments has been shown with respect to an example in which guide members are provided in both of the oppenings 40 and 41 to make the impedances differ from each other, but for example, where the opening 40 into which the recording medium 7 after development enters is provided inwardly of the copying apparatus body, the guide member may be provided only in the opening 41 or in other case, the guide member may of course be provided only in the opening 40.

Figure 10:
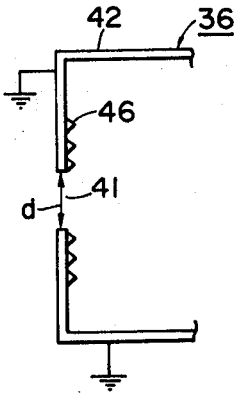
FIG. 10 illustrates the essential portions of an embodiment which improve over the embodiment of FIG. 9.

Further, as shown in FIG. 10, the guide member need not always be provided, but concavo-convexity 46 may be provided in the vicinity of the opening 41 whose height is d as mentioned previously, to make the impedance differ from each other and prevent matching of the high-frequency waves. Of course, the casing 36 formed of a metal need not always be grounded. In FIGS. 7 and 9, reference numeral 37 designates guide members for guiding the recording medium 7. They are provided at two locations before and after the fixing device 8. Reference numerals 26 and 27 denote conveyor rollers. If the guide members 37 and conveyor rollers 26, 27 are formed of the high-frequency wave absorbing material (mentioned previously), the effect will be even more improved.

As described above, in each embodiment, the impedances in the vicinity of the opening of the casing are made to differ from each other so as to cause an impedance variation or the impedance in the vicinity of the opening is made to differ from the impedance of the high-frequency wave generator means to prevent matching of the high-frequency wave and leakage thereof toward the outside of the apparatus or prevent leakage of the high frequency wave into the image recording apparatus.

Figure 11:
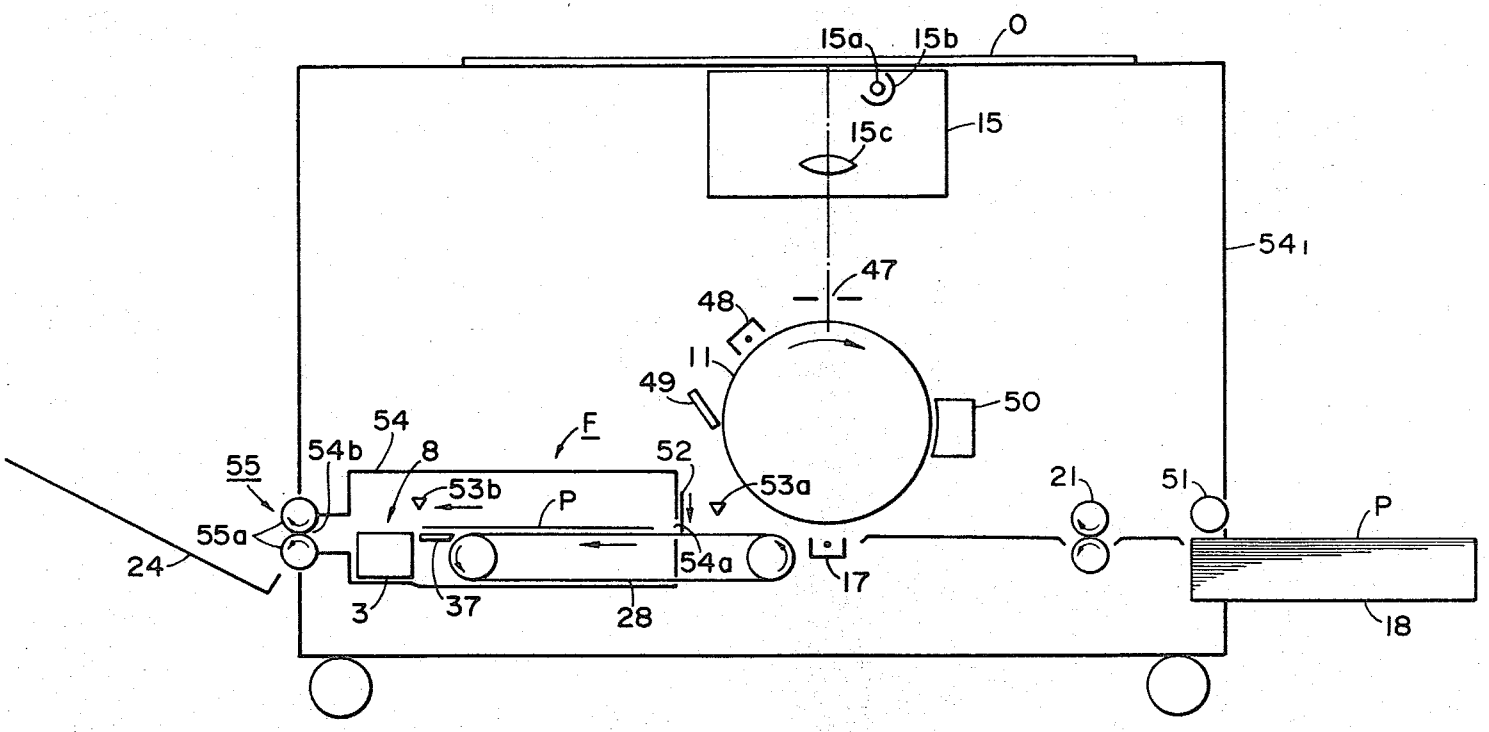
FIG. 11 illustrates yet another embodiment of the present invention.
Figure 12:
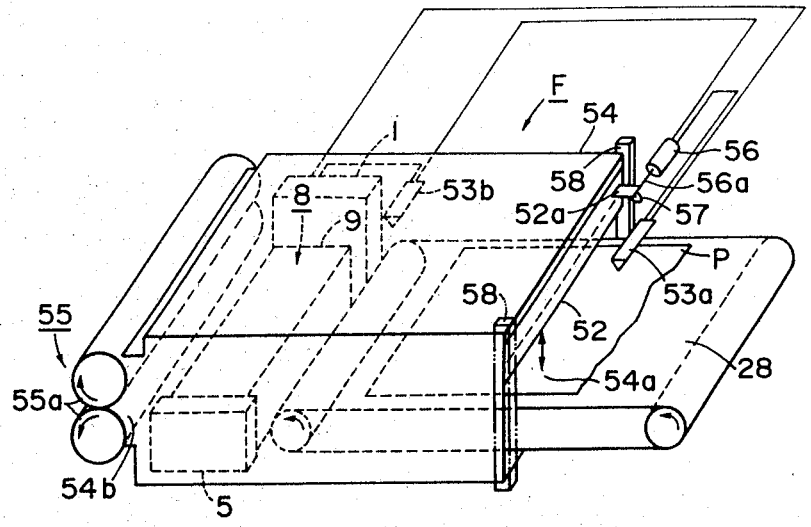
FIG. 12 is a perspective view of the fixing station of FIG. 11.

Reference is now had to FIGS. 11 and 12 to describe still another embodiment of the present invention.

FIG. 11 shows an embodiment of the electrophotographic apparatus to which the present invention is applied. In FIG. 11, reference numeral 11 designates a drum having an electrophotographic photosensitive medium on the peripheral surface thereof and rotatable in the direction of arrow. As it is rotated, the photosensitive drum 11 is first uniformly charged by a corona discharger 48, and then is exposed to the information light to be recorded such as the optical image of an original to be copied. Thereby, an electrostatic latent image is formed on the photosensitive drum 11. The above-mentioned information light is projected upon the photosensitive drum 11 through the fluorescent lamp 15*a*, reflecting plate 15*b* and lens 15*c* of an optical device 15 and a slit 47.

The latent image is developed into a visible image by a developing device 50 which supplies toner to the drum 11. The toner image thus obtained is transferred to a sheet of paper P as a recording medium by an image transfer charger 17. Sheets of paper P are taken out of a paper supply cassette 18 one by one by a paper feeding roller 51 and conveyed to an image transfer station provided with the charger 17, by register rollers 21 driven in synchromism with the rotation of the drum 11. By these register rollers 21, the leading end edge of the paper P is brought substantially into registration with the leading end edge of the toner image at the image transfer station.

After the image transfer, the paper P now bearing an unfixed toner image thereon is conveyed to a fixing station F by a conveyor belt 28 moved in the direction of arrow. A microwave guide tube 3 is disposed in the fixing station F, and the toner image transferred to the paper P is dielectrically heated by the microwave applied from the wave guide tube 3 and self-heats and melts, whereby it is fixed on the paper P. The toner, like the developer 9 of FIG. 2, contains an insulative component which self-heats due to the electrostatic induction phenomenon by the application of high-frequency wave. Preferable as such material are $BaTiO_3KH_2PO_4$, polyvinylidene fluoride, polysulfide rubber, etc. having a great dielectric loss. In addition to these, the toner may preferably contain resin components readily meltable by heat, for example, components such as polyethylene, phenol resin, etc. Of course, such resin components also self-heat due to the aforementioned electrostatic induction phenomenon.

In any case, the paper P after having passed through the fixing station F is discharged onto a tray 24 by paper discharge rollers 55. On the other hand, after the image transfer, the drum 11 is cleaned by a cleaning member 49, thus becoming ready for another cycle of image formation.

The fixing station F will now be described in detail by reference to FIG. 12. In FIGS. 11 and 12, there is schematically shown a fixing device in which a slit-like opening 54*a* as an inlet for paper P is provided in a shield box 54 for shielding the fixing station F and which has a high-frequency waves shielding function to prevent the high-frequency wave from leaking from the slit-like opening 54*a* to the outside of the fixing station F. In the present embodiment, the high-frequency wave shield comprises, for example, a shield box 54 surrounding a fixing function portion comprising an oscillator 1, a wave guide tube 3 and a cooling device 5, a shield member 52 for opening and closing an inlet 54*a* for paper P which is a recording medium, and a pair of rotatable rollers 55 disposed in an outlet 54*b* for paper P and formed of a microwave absorbing material 55*a* such as rubber. In this case, the rollers 55 of microwave absorbing material may be formed, for example, by metallic rigid cores and magnetic bodies including ferrite therein. The shield box 54 is a shield formed by a plate of iron or aluminum having some degree of thickness, for example a thickness of 1–2 mm. Now, the shield member 52 capable of opening and closing the inlet 54*a* for paper P is formed of the same material as the shield box 54, but alternatively, it may be formed of a microwave absorbing material. When paper P enters into the shield box 54 while being slidably held by a holding member 58 having its opposite ends secured to the shield box 54 and having a greater length than the thickness of the shield box 54, the movement of the paper P is detected by a sensor 53*a* provided short of the inlet 54*a* and a motor 56 is driven by the detection signal to rotate a cam 57 mounted on the shaft 56*a* of the motor and upwardly raise a projected piece 52*a* secured to the shield member 52, thereby raising and opening the openable-closable shield member 52 so as to provide a sufficiently opened condition to permit entry of the paper P. After the paper P has entered into the shield box 54 and when the leading end edge of the paper P arrives at a sensor 53*b* provided short of the wave guide tube 3, the motor 56 is caused to revolve in the reverse direction by the detection signal of this sensor to rotate the cam 57 in the reverse direction, so that the openable-closable shield member 52 lowers from gravity and the opening becomes closed.

It is preferable that the distance between the sensors 53*a* and 53*b* for detecting the paper P and the distance between the sensor 53*b* and the shield member 52 be greater than the width of the paper P with respect to the conveyance direction thereof. However, where the detection signals of the sensors 53*a* and 53*b* are delayed to drive the motor 56 and move the shield member 52, these distance relations are unnecessary, but the paper P should preferably be contained within the shield box. Simultaneously with the movement of the shield member 52, microwaves are generated from the oscillator 1 and fixation is effected through the high-frequency wave leaking fixation opening 4 on the wave guide tube 3. In this case, if the design is such that paper P arrives at the fixing station in a predetermined time (for example, four seconds) after the sensor 53*b* (or only the sensor 53*a*) has detected the leading end edge of the paper P, the oscillation of high-frequency waves will become stable. In the present embodiment, the distance from the sensor 53*b* to the inlet 54*a* is greater than the length of the fixable recording medium. In short, it will be sufficient if the shield member 52 closes the opening to such a degree that the leakage of high-frequency waves is shielded below a desired value.

The rollers 55 are provided on the outlet side of the shield box 54, and the outlet side of the shield box 54 is in contact or in proximity to the rollers 55 so as to effect electromagnetic wave shielding. These rollers 55 may discharge paper P having a fixed visualized image thereon and therefore, microwaves can be shielded without the visualizing agent being offset on the rollers 55. The rollers 55 need not always be provided if the leakage of microwaves from the outlet 54*b* of the shield box 54 is small (for example, if the opening is less than $\frac{1}{2}$ wavelength, preferably $\frac{1}{4}$ wavelength of the microwave), but the provision of the rollers 55 ensures the leakage of the microwaves to be shielded. Further, for the purpose of such shielding, if the rollers 55 are elastic, they will follow paper P and a great area of pressure contact will be provided and thus, more preferable shielding of microwaves will be provided.

As described above, in the foregoing embodiment, the openable-closable shield member 52 is provided to prevent the unfixed visualized image on a recording medium from being disturbed when the recording medium enters into the shield box 54, and the shield member is opened when the recording medium enters into the shield box and, during fixation, it is closed fully or to some extent to thereby prevent leakage of high-frequency waves. Also, the microwave absorbing rollers 55 are provided in the outlet for recording medium P, whereby prevention of leakage of microwaves is further improved and the image recording having a fixing station which is more stable and eliminates the wait time becomes possible. Of course, instead of providing the rollers 55 in the outlet for recording medium, an openable-closable shield member 52 similar to that provided in the inlet may be provided in the outlet.

Again in the present embodiment, a shield box $54_1$ for shielding the interior and exterior of the image recording apparatus is provided over the entire apparatus and high-frequency wave absorbing members are provided in the portions having openings.

Figure 13A:
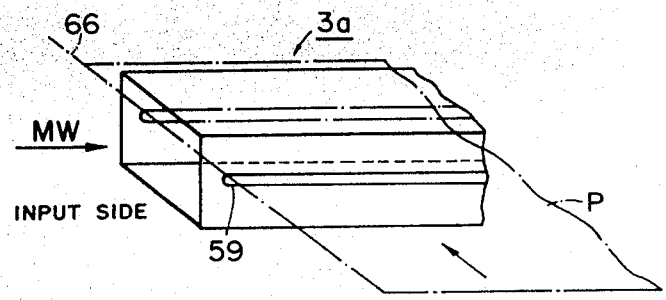
FIGS 13A, 13B and 13C illustrate heating-fixing devices applicable to the present invention.
Figure 13B:
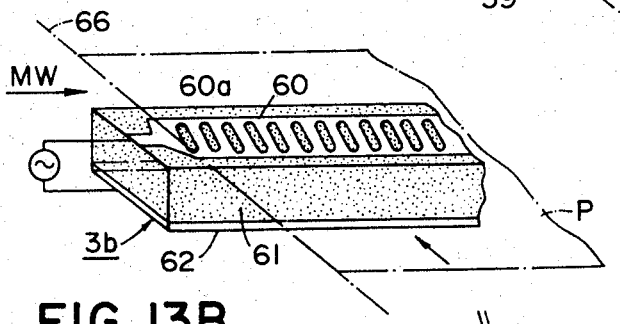
Figure 13C:
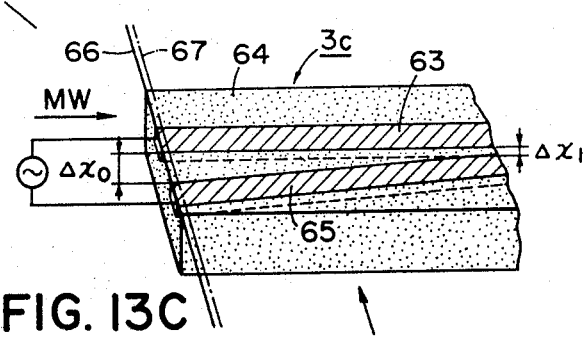

Reference is now had to FIGS. 13A, 13B and 13C to describe three examples of high-frequency wave applying means applicable to the present invention in lieu of the dielectric heating-fixing device 8.

The wave guide path (or tube) 3 in each of the above-described embodiments, as shown in FIG. 13A, is of the type which has a slot 59 in the direction of travel MW of microwaves of the wave guide tube 3*a*, and paper P is conveyed for fixation through the slot 59 along the input side standard 66. The wave guide path 3*b* of FIG. 13B utilizes a microstrip type dielectric substrate 61 and utilizes the leakage of microwaves from slits 60*a* provided in the surface conductor 60 thereof. Designated by 63 is a conductor which provides an opposed electrode provided on the reverse side. The slits 60*a* have a predetermined angle with respect to the conveyance direction of paper P. The standard 66 is provided in the first slit on the input side. Further, the wave guide path 3*c* of FIG. 13C comprises conductors 63 and 65 forming two electrodes on one surface of a dielectric substrate 64. This is called the slot line type which imparts microwaves to the visualized image and paper P by utilizing the concentration of microwave energy between the electrodes. The distance between these electrodes is such that it is $\Delta X_0$ on the input side and $\Delta X_1 (< \Delta X_0)$ toward the output side, whereby uniformization of microwaves over the full length of the wave guide path is provided. The standard 66 in the wave guide path 3*c* may preferably be positioned near the place whereat conductors 44 and 45 lying on a dielectric material 42 begin, or may be made into a standard 67 slightly deviated from said place toward the absorption side.

The present invention includes an embodiment in which the above-described constructions are arbitrarily combined together, and also the present invention is applicable to both a high-frequency wave dielectric fixing device and an induction heating-fixing device.

What we claim is:

1. An image recording apparatus comprising an outer casing;

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

first means for preventing the high-frequency waves from leaking out of said casing of said image recording apparatus; and second means provided in said casing for preventing the high-frequency waves from leaking out of the fixing station into said image recording apparatus.

2. An image recording apparatus according to claim 1, wherein said second means comprises a high-frequency wave absorbing rotatable member for conveying the recording medium, said rotatable member being provided in said recording medium conveyance path adjacent to said fixing station.

3. An image recording apparatus according to claim 2, wherein said rotatable member is provided adjacent to the inlet of said fixing station.

4. An image recording apparatus according to claim 1, 2 or 3, wherein said second means has a high-frequency wave reflecting member having a curved suface for utilizing high-frequency waves for fixing the visualized image on the recording medium.

5. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region and an outlet region through which the recording medium can go in and out relative to said fixing station and surrounding said fixing station; and a rotatable member for absorbing the high-frequency waves provided at a predetermined region in the conveyance path from said inlet region to said outlet region to convey the recording medium.

6. An image recording apparatus according to claim 5, wherein said high-frequency wave absorbing member is provided at the outlet region of said fixing station.

7. An image recording apparatus according to claim 5 or 6, wherein said high-frequency wave absorbing member is provided at the inlet region of said fixing station.

8. An image recording apparatus according to claim 5 or 6, wherein said rotatable member is a pair of rollers.

9. An image recording apparatus according to claim 8, wherein one of said pair of rollers is an elastic roller and has means for urging said pair of rollers against each other.

10. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region and an outlet region through which the recording medium can go in and out relative to said fixing station and surrounding said fixing station; and a member for absorbing high-frequency waves provided at a predetermined region in the conveyance path from said inlet region to said outlet region, wherein said absorbing member has ferrite dispersed therein.

11. An image recording apparatus according to claim 7, wherein said rotatable member is a pair of rollers.

12. An image recording apparatus according to claim 11, wherein one of said pair of rollers is an elastic roller and has means for urging said pair of rollers against each other.

13. An image recording apparatus according to claim 5 or 6, further having means for supplying a parting agent to said rotatable member.

14. An image recording apparatus according to claim 7, further having means for supplying a parting agent to said rotatable member.

15. An image recording apparatus according to claim 9, wherein the other of said pair of rollers is a metallic roller.

16. An image recording apparatus according to claim 12, wherein the other of said pair of rollers is a metallic roller.

17. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path fron said image formation station until the recording medium passes through said fixing station;

means having an inlet region and an outlet region through which the recording medium can go in and out relative to said fixing station and surrounding said fixing station; and a member for absorbing the high-frequency waves provided at a predetermined region in the conveyance path from said inlet region to said outlet region, wherein said absorbing member is formed of resin.

18. An image recording apparatus according to claim 17, wherein said absorbing member has ferrite dispersed therein.

19. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region and an outlet region through which the recording medium can go in and out relative to said fixing station and surrounding said fixing station; and a member for absorbing the high-frequency wave provided at a predetermined region in the conveyance path from said inlet region to said outlet region, wherein said absorbing member is formed of rubber material.

20. An image recording apparatus according to claim 16, 17, 18 or 19, wherein said surrounding means has a high-frequency wave absorbing member inside thereof.

21. An image recording apparatus according to claim 2, wherein said surrounding means has a casing member formed of a metal.

22. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region through which the recording medium enters into said fixing station and an outlet region through which the recording medium discharges from said fixing station, said means surrounding said fixing station; and control means provided at at least one of said inlet region and outlet region for controlling the passage area through which the recording medium passes.

23. An image recording apparatus according to claim 22, further having means for absorbing the high-frequency wave at said outlet region.

24. An image recording apparatus according to claim 22 or 23, wherein said control means has means for opening-closing the passage area of said inlet region.

25. An image recording apparatus according to claim 22 or 23, further having means for detecting the position of the recording medium and wherein said control means is operated in accordance with a signal detected by said detector means.

26. An image recording apparatus according to claim 24, further having means for detecting the position of the recording medium and wherein said opening-closing means is operated in accordance with a signal detected by said detector means.

27. An image recording apparatus according to claim 26, wherein said opening-closing means has a member moving through the passage area of said inlet region.

28. An image recording apparatus according to claim 23, wherein said absorbing means has a rotatable member concerned with conveyance of the recording medium.

29. An image recording apparatus according to claim 28, wherein said rotatable member is a pair of rollers.

30. An image recording apparatus according to claim 28 or 29, wherein said rotatable member is formed of rubber or resin.

31. An image recording apparatus according to claim 22, wherein said surrounding means has a casing member for intercepting the high-frequency wave.

32. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from the image formation station until the recording medium passes through said fixing station;

means having an opening region through which the recording medium can pass along said conveyance path, said means surrounding said fixing station; and impedance changing means for making the impedance of said opening region differ from the applied high-frequency wave impedance of said fixing station, wherein said impedance changing means has at said opening region a guide opening portion having a length greater than the half-wavelength of the high-frequency waves with respect to said recording medium conveyance path.

33. An image recording apparatus according to claim 32, wherein the length of said guide opening portion is equal to or greater than one wavelength of the high-frequency waves.

34. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an opening region through which said recording medium can pass along said conveyance path, said means surrounding said fixing station; and impedance changing means for making the impedance of said opening region differ from the applied high-frequency wave impedance of said fixing station, wherein said impedance changing means has a concavo-convex portion at said opening region.

35. An image recording apparatus according to claim 34, wherein said concave-convex portion is provided at an upper portion of said opening region relative to the recording medium conveyance direction.

36. An image recording apparatus according to claim 35, wherein said concave-convex portion is also provided at a lower portion of the opening region.

37. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an opening region through which the recording medium can pass along said conveyance path, said means surrounding said fixing station;

impedance changing means for making the impedance of said opening region differ from the applied high-frequency wave impedance of said fixing station; and a member for absorbing high-frequency provided at or around said opening region.

38. An image recording apparatus according to claim 31, 33 or 34, further having a high-frequency wave absorbing member at or around said opening region.

39. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region and an outlet region through which the recording medium can go in and out relative to said fixing station, said means surrounding said fixing station and including a first high-frequency wave-absorbing member, having ferrite dispersed therein, inside thereof; and a second member for absorbing high-frequency waves provided at a predetermined region in the conveyance path from said inlet region to said outlet region.

40. An image recording apparatus having:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region and an outlet region through which the recording medium can go in and out relative to said fixing station, said means surrounding said fixing station and having a first high-frequency wave absorbing member, formed of resin, inside thereof; and a second member for absorbing high-frequency waves provided at a predetermined region in the conveyance path from said inlet region to said outlet region.

41. An image recording apparatus according to claim 40, wherein said second absorbing member has ferrite dispersed therein.

42. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an inlet region and an outlet region through which the recording medium can go in and out relative to said fixing station, said means surrounding said fixing station and having a first high-frequency wave absorbing member formed of rubber material; and a second member for absorbing high-frequency waves provided at a predetermined region in the conveyance path from said inlet region to said outlet region.

43. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station;

means having an opening region through which said recording medium can pass along said conveyance path, said means surrounding said fixing station, and impedance changing means for making the impedance of said opening region differ from the applied high-frequency wave impedance of said fixing station, said impedance changing means making the height of said opening region gradually reduced relative to the recording medium conveyance direction in the vertical direction, wherein at least the height of a part thereof is smaller than the half-wavelength of the high-frequency waves.

44. An image recording apparatus according to claim 34, 35, 36, 37, or 43, wherein said impedance means has at said opening region a guide opening portion having a length greater than half-wave length of the high-frequency waves with respect to said recording medium conveyance path.

45. An image recording apparatus according to claim 44 wherein the length of said guide opening portion is equal to or greater than one wavelength of the high-frequency waves.

46. An image recording apparatus comprising:

an image formation station for causing a recording medium to bear a visualized image;

a fixing station for applying high-frequency waves to thereby fix the visualized image on the recording medium thereby to record the image;

means for conveying the recording medium along a conveyance path from said image formation station until the recording medium passes through said fixing station; and a pair of rotatable members provided at the discharge side of said fixing station for passing therebetween the recording medium for conveyance and for preventing leakage of the high-frequency waves.

47. An image recording apparatus according to claim 35, wherein said pair of rotatable members includes a high-frequency absorbing roller.

48. An image recording apparatus according to claim 46 or 47, wherein said rotatable members includes a high-frequency reflecting roller.

* * * * *

UNITED STATES PATENT AND TRADEMARK OFFICE

CERTIFICATE OF CORRECTION

PATENT NO. : 4,435,072

DATED : March 6, 1984

INVENTOR(S) : HIROYUKI ADACHI, ET AL.

It is certified that error appears in the above-identified patent and that said Letters Patent is hereby corrected as shown below:

In the Abstract, line 8, "passage" should read --passes--.

Column 1, line 23, delete "a" after "compact";
line 32, delete "a" after "of";
line 50, insert --are-- after "waves".

Column 2, line 16, "conjuction" should read --conjunction--;
line 33, "protions" should read --portions--.

Column 3, line 61, "microwave" should read --microwaves--.

Column 5, line 19, "menber" should read --member--;
line 25, "dielectric having device 8" should read --dielectric heating device 8--.

Column 6, line 55, "covexity" should read --convexity--;
line 59, "differ" should read --different--.

Column 7, line 4, "freuency" should read --frequency--;
line 7, "attanuated" should read --attenuated--;
line 15, insert --each-- after "from";
line 38, "oppenings" should read --openings--;
line 44, insert --the-- before "other".

Column 8, line 28, "synchromism" should read --synchronism--;
line 44, "wave" should read --waves--;
line 63, "waves" should read --wave--;
line 64, "wave" should read --waves--.

Column 9, line 11, insert --,-- after "example".

UNITED STATES PATENT AND TRADEMARK OFFICE

CERTIFICATE OF CORRECTION

PATENT NO. : 4,435,072

DATED : March 6, 1984

INVENTOR(S) : HIROYUKI ADACHI, ET AL.

It is certified that error appears in the above-identified patent and that said Letters Patent is hereby corrected as shown below:

Claim 17, Column 12, line 40, "fron" should read --from--.

Claim 19, Column 13, line 1, "wave" should read --waves--.

Claim 20, Column 13, line 7, "16, 17, 18 or 19" should read --10, 17, 18 or 19--.

Claim 21, Column 13, line 10, "2" should read --20--.

Claim 23, Column 13, line 32, "wave" should read --waves--.

Claim 31, Column 13, line 60, "wave" should read --waves--.

Claim 38, Column 14, line 66, "31" should read --32--.

Claim 47, Column 16, line 53, "35" should read --46--.

Claim 48, Column 16, line 56, "includes" should read --include--.

Signed and Sealed this

*Sixteenth* Day of *October 1984*

[SEAL]

*Attest:*

*Attesting Officer*

GERALD J. MOSSINGHOFF

*Commissioner of Patents and Trademarks*